United States Patent [19]

Tsui

[11] Patent Number: 4,852,497

[45] Date of Patent: Aug. 1, 1989

[54] TOY FOR DEMOSTRATING MAGNETIC FORCE AND THE EFFECTS OF AIR PRESSURE

[76] Inventor: Yu-Ming Tsui, No. 34-3, Alley 31, Lane 59, Sec. 5, Nanking E. Rd.,, Taipei, Taiwan

[21] Appl. No.: 533,427

[22] Filed: Sep. 16, 1983

[51] Int. Cl.[4] ..... B61B 13/10

[52] U.S. Cl. ..... 104/138.1; 104/283

[58] Field of Search ..... 104/138 R, 281, 283, 104/286, 120, 118; 105/145; 446/257, 253, 1 K, 260, 216, 259

[56] References Cited

U.S. PATENT DOCUMENTS

| | | | |
|---|---|---|---|
| 1,336,732 | 4/1920 | Davy | 104/138 R |
| 3,570,177 | 3/1970 | Tomaro | 46/260 |
| 3,590,522 | 7/1971 | Hamano | 46/231 |
| 3,807,312 | 4/1974 | Flodell | 104/119 X |
| 3,951,075 | 4/1976 | Miericke | 104/281 X |
| 4,299,173 | 11/1981 | Arima et al. | 104/281 X |

FOREIGN PATENT DOCUMENTS 1813995 12/1969 Fed. Rep. of Germany ... 104/138 R

*Primary Examiner*—Robert B. Reeves
*Assistant Examiner*—Frank Williams
*Attorney, Agent, or Firm*—Berman, Aisenberg & Platt

[57] ABSTRACT

In a magnet-floating toy running inside a loop of vacuum-like state, a ⊥ shape monorail is provided within a loop of air-tight, transparent round pipes, air within the loop is drawn by suction to make loop reach a vacuum-like state to reduce air resistance. In the two extended wings of the monorail and also underneath the surfaces of the car body, permanent magnets are installed and are arranged so that the magnet poles of the two magnets are the same to induce repulsion force and that when the car rides on the monorail, it may float. Power is supplied from source outside the loop to the conductive rail mounted in the top surface of the monorail and through the brush, then in turn, transmit to the motor. Thus motor will enable car to run within the loop.

6 Claims, 2 Drawing Sheets

TOY FOR DEMOSTRATING MAGNETIC FORCE AND THE EFFECTS OF AIR PRESSURE

This invention is concerned with a magnet-floating toy running inside a loop of vacuum-like state.

The toy of this invention comprises a transparent air-tight plastic round pipe, a ⊥ shape monorail within the said pipe, and a car. In the two extended wings of the monorail and underneath the lower surfaces of the said car, permanent magnets are installed so that the magnet poles of the two are the same to induce repulsion force, and thereby when the said car rides on the said monorail, it may float. The air within the said pipe is pumped out to attain a vacuum-like state and D.C. power is supplied outside the loop to the car by which the brush disposed under the said car and conductive rail on the said monorail then enables the said car to run on the monorail within the said pipe.

A preferred embodiment of the invention will now be described with reference to the accompanying drawings, in which.

Figure 1:
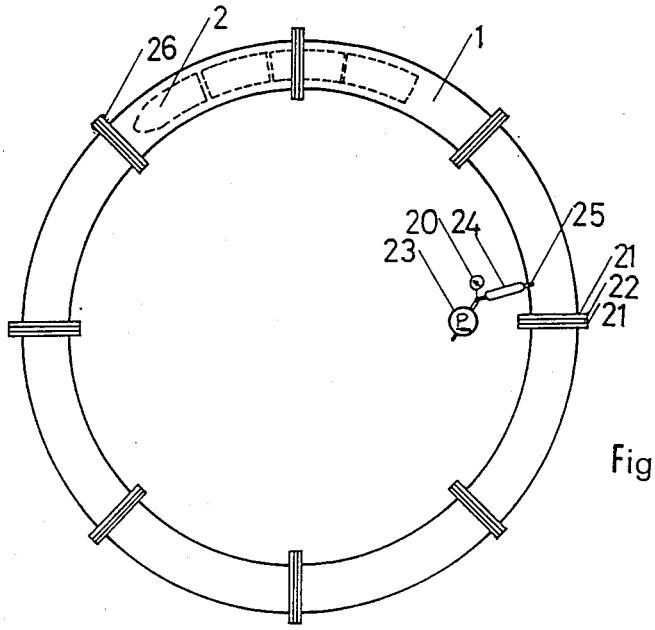
FIG. 1 is a top elevational view of the magnet-floating toy within the loop in accordance with the invention.
Figure 2:
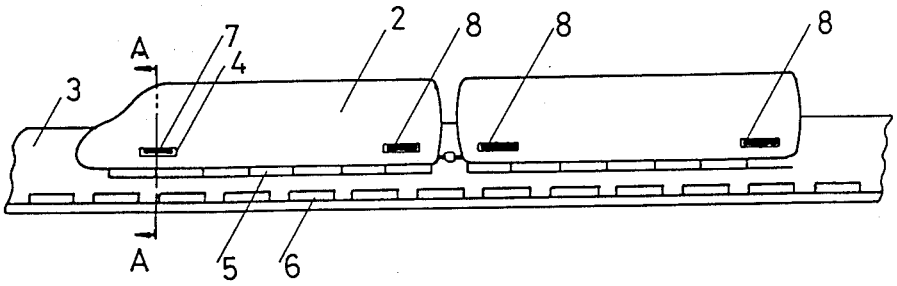
FIG. 2 is the side elevational view of the magnet-floating toy according to FIG. 1 whereas the pipe has been removed.

In FIG. 1, loop 1 comprises of transparent curved round pipe sections, and at the ends of each pipe section, flange 21 is provided. Between the flanges of two adjacent pipes, packing 22 is mounted therein and sealed by known means, such as bolts and nuts, so that the said loop 1 is air-tight sealed. An exhaust outlet 25 provides an appropriate position in loop 1 for exhaust pipe 24 to draw air within loop 1 by vacuum pump 23 so that loop 1 can reach a vacuum-like state. A vacuum gauge 20 is installed in the said exhaust pipe 24 to measure the degree of vacuum inside loop 1.

Figure 3:
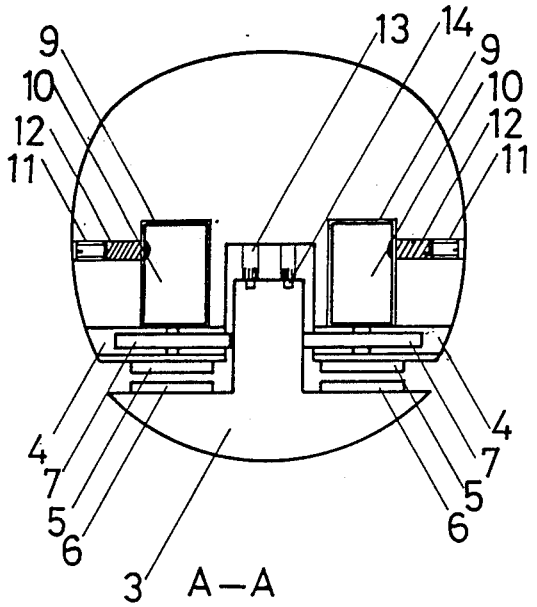
FIG. 3 is the cross-sectional view of A—A line taken from FIG. 2.

A car 2 may be in any forms, such as a tram, train, cart, and there may be one or more cars connected by known means, such as hooks. In the first car, there provides a pair of horizontal drive wheels 7,7 in the front end and a pair of horizontal auxiliary wheels 8, 8 in the back end within the rectangular opening 4 disposed horizontally on the sides of the car body spaced by the dent (FIG. 3). Above each said opening 4, in the front end, there provides a compartment 9 within car body. Within the said compartment 9, a motor 10 is mounted therein secured by spring 12 and adjustable by screw 11. Motor 10 and drive wheel 7 are coaxial so that wheel 7 rests against the vertical wall of monorail 3. In the dent portion of the lower part of car body 2, a pair of brushes 13, 13 is provided and they are connected with motor 10. Underneath the lower sides of car body 2 adjacent to dent portion, there provides two rows of permanent magnets 5 spacely arrenged on each side.

Monorail 3 is in ⊥ shape. In the two extended wings of monorail 3 there are two rows of permanent magnets 6 installed on each side. The permanent magnets 5 and 6 are arranged so that each row of magnets 5 and 6 has the same magnet poles and that the two rows opposite to each other have also the same poles that repulsion force may be induced. When car 2 is placed on monorail 3, the magnet repulsion force produced between magnets 5 and 6 will enable car 2 to float.

Figure 4:
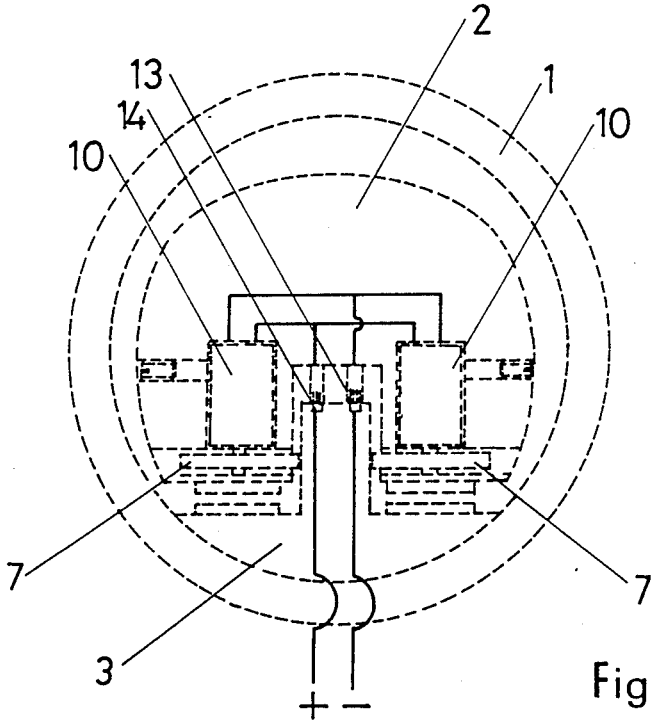
FIG. 4 is the electric circuit of the invention.

On the top surface of monorail 3, a pair of conductive rail 14 is mounted thereon. They correspond to the brushes mounted in the dent beneath the car body 2. As shown in FIG. 4, brushes 13, 13 and motors 10, 10 are related in such a way that motor 10, 10 will rotate wheels 7, 7 inwardly against the vertical wall of monorail 3 to move car 2 along.

In order to make car 2 run smoothly on monorail 3 within loop 1, monorail 3 may be constructed that it leans slightly forward to the center of loop 1.

It is to be understood that in order to cope with the different car used, the number and location of the said driven wheels and/or auxiliary wheels also should vary accordingly.

The operation of the invention will now be explained.

First the air within pipe 1 is drawn by vacuum pump 23 to keep loop 1 in a vacuum-like state. When the switch outside loop 1 is connected, electric current will flow to conductive rail 14 and transmit to brush 13 to operate motor 10 within car 2 which in turn enables wheels to rotate and thus car 2 will be able to run on monorail 3 within loop 1. As the car speed may be controlled by SCR device (not shown) connected to the switch, the relationship between car speed and degree of vacuum can be measured and calculated. Thus, the toy is also educational.

The magnet-floating toy according to the invention has the following effects:

(1) It inspires children with the phenomenon of magnet-floating principle which may be appied to the transportation systems;

(2) It teaches children the relationship between air resistance and force; and (3) By means of different degree of vacuum, one may observe the relationship of air resistance and toy speed.

Thus the invention renders not only amusement but also educational effect on children.

While the invention has been particularly shown and described with reference to preferred embodiments thereof, it will be understood by those skilled in the art that the foregoing and other changes in form and details can be made therein within the scope of the invention.

I claim:

1. A toy comprising an air-tight hollow pipe forming a closed loop, rail means comprising a central upstanding portion and two annular portions, said annular portions being an opposite sides of said central portion, a toy vehicle for moving along said rail means and having a recess for receiving said central portion and wheel means consisting of wheels rotatably mounted to said vehicle engaging said central portion for causing said vehicle to move along said rail means, first permanent magnet means located on said two annular portions and second permanent magnet means located on said vehicle, said first and second permanent means being arranged to provide a repulsive force to support the weight of said vehicle, and selectively controlable exhausting means for providing a selected and variable air pressure in the entire said closed loop, whereby a toy for teaching the effects of air and magnetic fields is provided.

2. A toy as claimed in claim 1, in which said vehicle is provided with horizontal auxiliary wheels which rest against said central portion.

3. A toy as claimed in claims 1 or 2, further comprising a motor for driving said wheel means which is urged against a vertical wall of said central portion by a spring force exerted by a spring attached adjacent said motor.

4. A toy as claimed in claim 1 in which brushes are provided in said recess and is connected to said motor, and conductive rails disposed on the top of said central portion and connected to a power source outside the loop whereby power can be supplied to the motor through the conductive rails and brushes.

5. A toy as claimed in claim 1, in which a vacuum-like state is maintained by drawing air through a vacuum pump.

6. A toy as claimed in claim 3, in which a screw is provided to adjust the force of said spring.

* * * * *